US008389882B2

(12) United States Patent
Hallet

(10) Patent No.: US 8,389,882 B2
(45) Date of Patent: Mar. 5, 2013

(54) ELECTRICAL SWITCH FOR A MOTOR VEHICLE

(75) Inventor: Michel Hallet, Mondeville (FR)

(73) Assignee: SC2N, Creteil (FR)

( * ) Notice: Subject to any disclaimer, the term of this patent is extended or adjusted under 35 U.S.C. 154(b) by 379 days.

(21) Appl. No.: 12/663,733

(22) PCT Filed: Jun. 18, 2008

(86) PCT No.: PCT/EP2008/057715

§ 371 (c)(1),
(2), (4) Date: May 19, 2010

(87) PCT Pub. No.: WO2008/155360

PCT Pub. Date: Dec. 24, 2008

(65) Prior Publication Data

US 2010/0219052 A1 Sep. 2, 2010

(30) Foreign Application Priority Data

Jun. 20, 2007 (FR) ..... 07 04397

(51) Int. Cl.
*H01H 9/00* (2006.01)

(52) U.S. Cl. ..... 200/61.54

(58) Field of Classification Search ..... 200/61.54, 200/16 A, 16 R–16 D, 531, 537, 547, 549, 200/550, 252

See application file for complete search history.

(56) References Cited

U.S. PATENT DOCUMENTS

| | | | | |
|---|---|---|---|---|
| 3,632,909 | A * | 1/1972 | Rowley | 200/16 D |
| 3,946,181 | A | 3/1976 | Takamizawa et al. | |
| 4,352,964 | A * | 10/1982 | English | 200/5 A |
| 2007/0017788 | A1 | 1/2007 | Mano | |

OTHER PUBLICATIONS

International Search Report w/translation from PCT/EP2008/057715 dated Oct. 15, 2008 (4 pages).

* cited by examiner

*Primary Examiner* — Edwin A. Leon
(74) *Attorney, Agent, or Firm* — Osha Liang LLP

(57) ABSTRACT

A contactor carriage fitted so as to move translationally in an electrical switch of a motor vehicle, in a unit providing controls under the steering wheel, in order to establish according to a user command, an electrical contact for one or more predefined positions of the path of the carriage is disclosed. The carriage has at least one electrical contacting emplacement, a first housing for accommodating a high-current contactor element and a second housing for accommodating a low-current contactor element. An electrical contact is established at said emplacement either by placing a high-current contactor element in the associated housing or by placing a low-current contactor element in said housing.

15 Claims, 3 Drawing Sheets

ELECTRICAL SWITCH FOR A MOTOR VEHICLE

FIELD OF THE INVENTION

The present invention relates to the field of electric switches for motor vehicles and in particular of switches of a control assembly beneath the steering wheel of a motor vehicle.

BACKGROUND ART

Many electric switch structures have already been proposed. In particular, electric switches are known with a contactor carriage mounted so as to be able to move in translation in order to establish, according to a command of a user, an electric contact for one or more predefined positions of the path of the carriage.

These weak-current or strong-current contactor carriages make it possible to establish the electric contact, notably by friction contact facing sets of conductive electric tracks in order to modify switching states.

A "weak current" is a current designed to broadcast, collect or exchange information in the form of electric signals. The currents in question are sometimes very weak (a few mA to a few μA).

In contrast, a "strong current" is a current capable of providing electric energy notably designed for functions of lighting, heating and driving force (lamps, resistors, motors, etc.). The currents in question are of the order of a few hundred mA to several A.

It is understood that the performance required, notably in mechanical and electrical resistance, of weak-current or strong-current contactor carriages is not at all the same. Notably, strong-current contactors must withstand possible electric arcs which may be formed and which may damage the electric contact.

However, in the motor vehicle field, certain vehicle options are chosen by the customer at the last moment of assembly of the vehicle.

It is then necessary that the switches of the control assembly, and in particular of the controls under the steering wheel, possess a great deal of modularity and can therefore be easily inverted depending on the wishes of the customer.

SUMMARY OF THE INVENTION

The object of the present invention is therefore to propose an electric switching device of a motor vehicle having a greater degree of modularity.

Accordingly, the subject of the invention is a contactor carriage designed to be mounted so as to move in translation in an electric switch of a motor vehicle, preferably in an assembly of controls beneath the steering wheel, in order to establish, according to a command of a user, an electric contact for one or more predefined positions of the path of said carriage, comprising at least one location of electric contact, characterized in that it comprises a first housing designed to receive a strong-current contactor element, and a second housing designed to receive a weak-current contactor element, so that an electric contact is capable of being established at said location either by the installation of a strong-current contactor element, or by the installation of a weak-current contactor element in the associated housing.

A further subject of the invention is an electric switch of an assembly of controls beneath the steering wheel of a motor vehicle, characterized in that it comprises a contactor carriage as defined above, and in that it also comprises at least one weak-current or strong-current contactor element in order to establish, according to a command of a user, an electric contact at one or more given positions on the path of said carriage.

A further subject of the invention is an elastic weak-current contact strip designed to be installed in a housing of a contactor carriage as defined above, in order to establish, according to a command of a user, an electric contact for one or more predefined positions of the path of said carriage, comprising at least one location of electric contact, so that an electric contact is capable of being established at said location, characterized in that it has the shape of a fork having at least two branches capable of establishing two simultaneous electric contacts and in that each branch has a curved end.

BRIEF DESCRIPTION OF THE DRAWINGS

Other advantages and features will appear on reading the description of the invention and the appended drawings in which.

DETAILED DESCRIPTION

In these figures, identical elements bear the same reference numbers.

Figure 1:
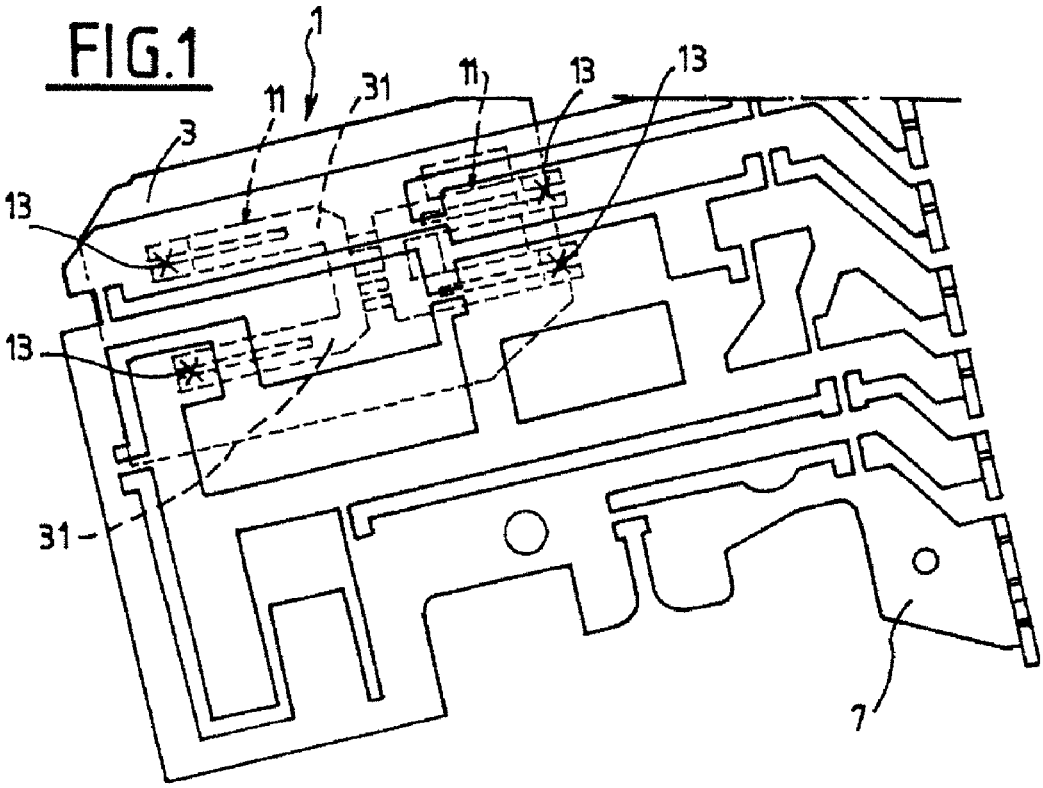
FIG. 1 is a bottom view of the electric switch according to the invention on a circuit track.
Figure 2:
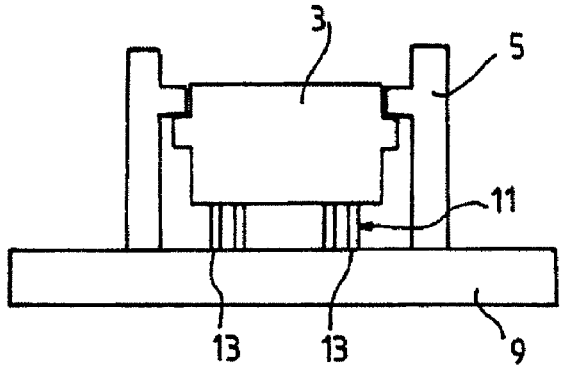
FIG. 2 is a schematic side view of the electric switch of FIG. 1, FIGS. 3, 4, 5 and 6 are bottom views in perspective of variant embodiments of the electric switch.

FIGS. 1 and 2 illustrate a portion of an electric switch 1 of a motor vehicle, such as that of an assembly of controls beneath the steering wheel of a motor vehicle.

The switch 1 comprises a contactor carriage 3 mounted so as to be able to move in translation, for example with the aid of a slide 5, on a set of conductive electric tracks 7 of a printed circuit board 9 (see FIG. 2).

The movement in translation of the contactor carriage 3 establishes, according to a command of a user, an electric contact for one or more predefined positions of the path of the carriage 3.

At least one weak-current contactor element 11 or strong-current contactor element 12 is installed in a housing 15, 17, of the carriage 3.

Figure 3:
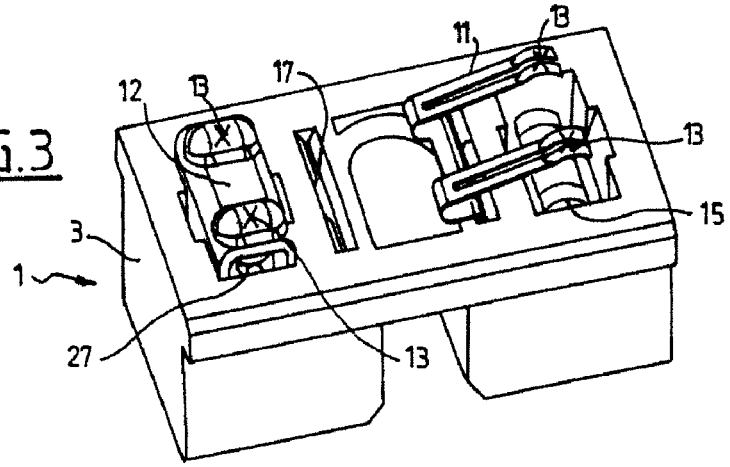

It is therefore possible to provide a switch 1 having a strong-current contactor element 11 and a weak-current contactor element 12 (FIG. 3).

Figure 4:
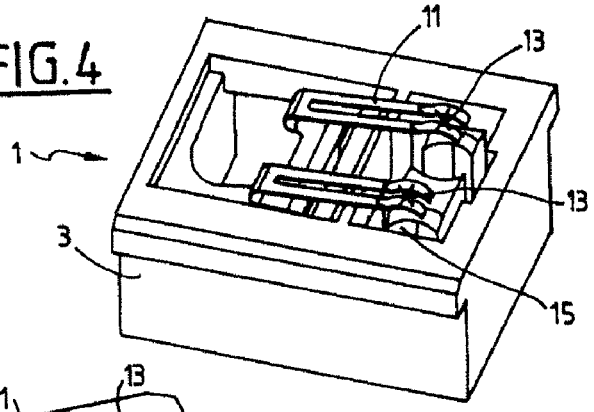
Figure 5:
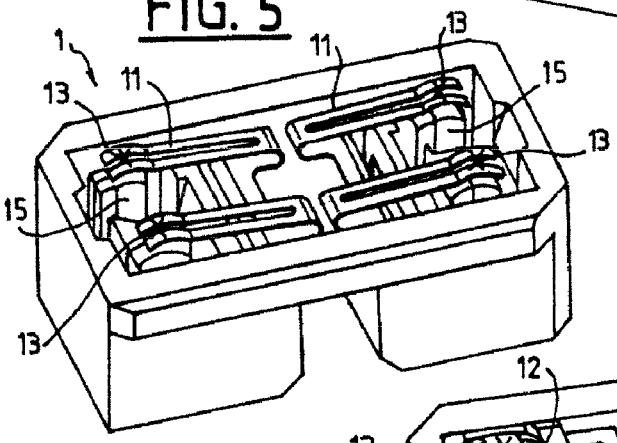

Alternatively, it is possible to provide a switch 1 comprising a single weak-current contactor element 11 (FIG. 4), or two weak-current elements 11 (FIGS. 1 and 5).

Figure 6:
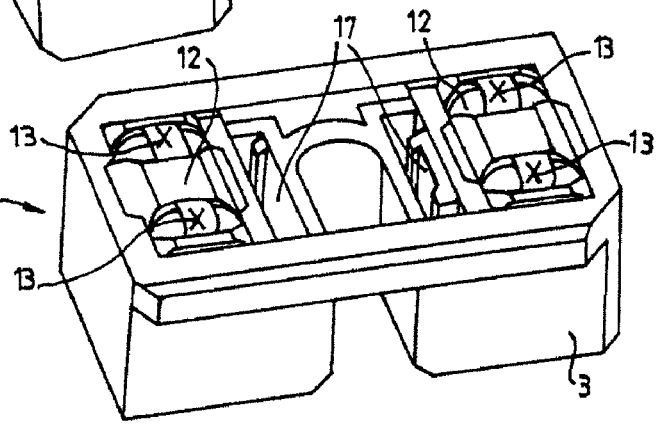

It is also possible to provide a switch 1 comprising one or two strong-current contactor elements 12 (FIG. 6).

The electric contact modifying the switching states is established in at least one electric contact location 13, by friction contact of the contactor elements 11 or 12 facing the electric tracks 7.

Figure 7:
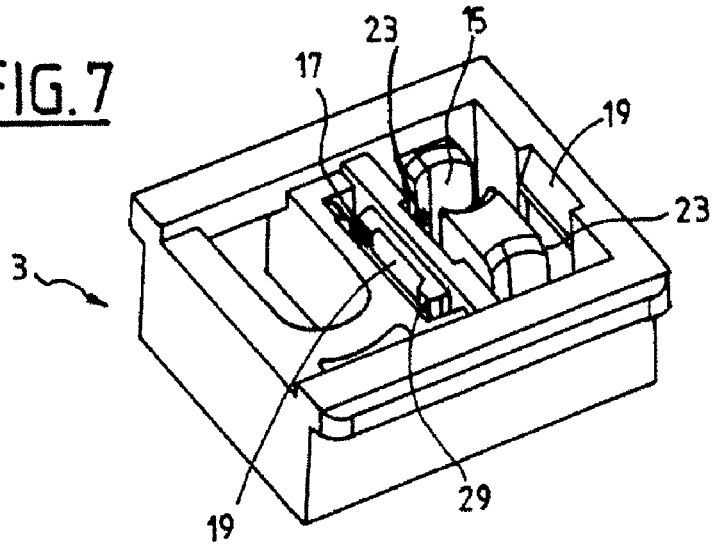
FIG. 7 is a bottom view in perspective of a contactor carriage.
Figure 8:
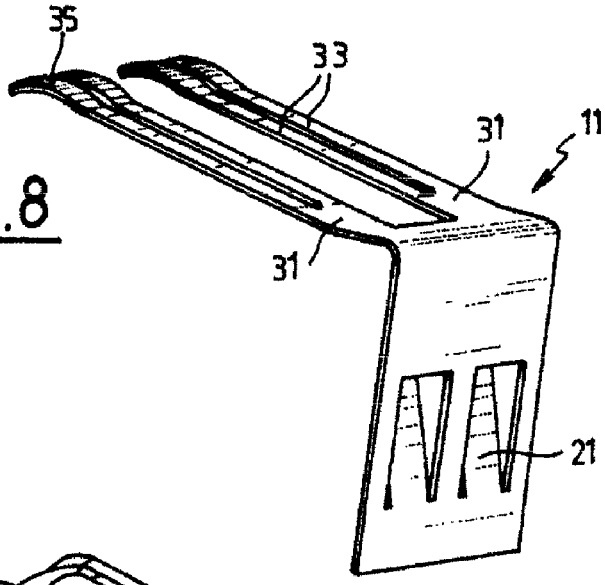
FIG. 8 is a view in perspective of a weak-current contactor element.

A more detailed description will now be given of the contactor carriage 3 (FIG. 7), and then of the strong-current contactor element 12 (FIG. 9) and weak-current contactor element 11 (FIG. 8).

The contactor carriage 3 comprises a first housing 15 designed to receive a strong-current contactor element 12, and a second housing 17 designed to receive a weak-current contactor element 11, so that an electric contact is capable of being established in the location either by the installation of a strong-current contactor element 12, or by the installation of a weak-current contactor element 11 in the associated housing 15, 17.

It is therefore possible to have the choice either of a weak-current contactor element 11 or a strong-current contactor element 12 for the establishment of the electric contact necessary to apply the desired switching in the location 13 of the electric circuit 7.

In addition, provision is made for the carriage 3 to comprise a first snap-fitting means 19 (FIG. 7) designed to interact with a second complementary snap-fitting means 21 supported by the contactor element 11, in order to attach the contactor element 11, 12 removably to the carriage 3.

Therefore, it is possible to modify the strong-current contactor element 12 with a weak-current contactor element 11 and vice versa even though the assembly has already been carried out, also adding flexibility of production to the switch 1.

The first snap-fitting means 19 advantageously comprises a protuberance or a hole. In the embodiment illustrated in FIG. 7, the first snap-fitting means 19 comprises a coupling protuberance.

The first housing 15 is defined, for example, by at least two slots 23 designed to interact with a corresponding strong-current contactor element 12.

Figure 9:
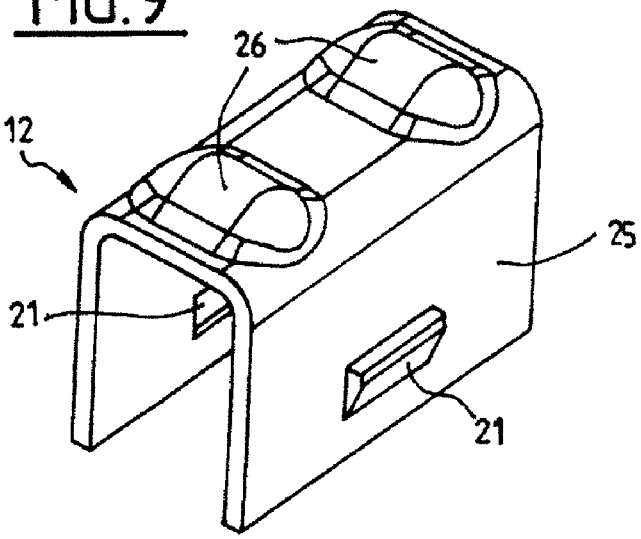
FIG. 9 is a view in perspective of a strong-current contactor element.

Advantageously, the strong-current contactor element 12 comprises a contactor bridge 25 (FIG. 9).

Preferably, the contactor bridge 25 comprises two excrescences 26 capable of establishing two simultaneous electric contacts in the locations 13 (FIG. 9).

The two simultaneous contacts make it possible to double the switching function, thereby making it possible to enhance the switching safety of the switch 1.

The first snap-fitting means 21 of the strong-current contactor element 12 is advantageously formed by two complementary protuberances supported by the flanges of the bridge 25, on the outer faces.

FIG. 3 shows that the strong-current contactor element 12 comprises an elastic return spring 27 of the contactor bridge 25 placed between the arch of the bridge 25 and the carriage 3.

Therefore, the bridge 25 is constantly elastically pressed against tracks of the circuit 7.

Returning to FIG. 7, it can be seen that the second housing 17 is defined by at least one slot 29 designed to interact with a corresponding weak-current contactor element 11, such as an elastic contact strip, so that an electric contact is capable of being established in the location 13.

Advantageously, provision is made to place the slots 23 of the first housing 15 parallel with the plane defined by the slot 29 of the second housing 17, in order to gain compactness.

More precisely, and as can be seen in FIG. 8, the elastic strip 11 advantageously has a first end that can move pivotingly in the form of a fork designed to establish an electric contact.

The second end is designed to be housed in the slot 29 to keep the contactor element 11 in the carriage 3.

The two ends join together forming an angle substantially greater than a right angle, obtained for example by folding the strip 11.

Therefore, the end designed to establish an electric contact is elastically pushed against the tracks of the electric circuit.

Advantageously, the first end in the shape of a fork has at least two branches 31 capable of establishing two simultaneous electric contacts.

As in the embodiment described of the strong-current contactor element 12, the two simultaneous electric contacts are provided in the weak-current contactor element 11 for safety of switching.

Preferably, each branch 31 comprises at least two contactor arms 33 and each branch 31 or contactor arm 33 has a curved end 35.

The spacing between the two branches 31 depends on the spacing between the electric tracks 7 of the control device.

Therefore, in FIG. 1, the spacing between the two branches 31 is not the same for the two weak-current contactor elements 11. It corresponds to the particular arrangement of the conductive tracks 7 of the bottom electric circuit.

Alternatively, the spacing is the same between the two branches 31 of two distinct elastic strips 11 mounted in the switch 1, which makes production easier (FIG. 5).

The first snap-fitting means 21 of the contactor element 11 is advantageously formed by at least one, and preferably two, elastic hooks capable of interacting with the coupling protuberance 19 of the carriage 3.

For ease of production, the hooks are cut directly from the elastic strip 11.

In an advantageous manner, provision is made, in a contactor carriage 3 comprising two contactor elements 11, 12, for the first housings 15 designed for the strong-current contactor elements 12 to be situated on the edges of the carriage 3 relative to the second housings 17 designed for the weak-current contactor elements 11, situated in the center.

Specifically, it is easier to arrange an elastic strip 11 housed in the second housing 17 and of which the fork is extended to the location 13, passing over the first housing 15 than to do the reverse.

Therefore, a modulatable electric switching device 1 is obtained comprising a contactor carriage 3 comprising a first housing 15 designed to receive a strong-current contactor element 12, and a second housing 17 designed to receive a weak-current contactor element 11, so that an electric contact can be established in the location 13 either by installing a strong-current contactor element 12, or by installing a weak-current contactor element 11 in the associated housing 15, 17, making it possible to provide at will a weak-current electric contact or a strong-current electric contact, without having to completely modify the switch, and therefore the control lever containing said switch under the steering wheel.

The invention claimed is:

1. A contactor carriage, wherein the contactor carriage is mounted to move in translation in an electric switch of a motor vehicle, in an assembly of controls beneath a steering wheel of the motor vehicle, in order to establish, according to a command of a user, an electric contact for one or more predefined positions of the path of said carriage, the contactor carriage comprising:

at least one location of electric contact;

a first housing for receiving a strong-current contactor element; and a second housing for receiving a weak-current contactor element, so that an electric contact is established at said at least one location by one of installation of the strong-current contactor element in the first housing, or by installation of the weak-current contactor element in the second housing.

2. The contactor carriage as claimed in claim 1, wherein the first housing is defined by at least two slots which interact with the corresponding strong-current contactor element and the second housing is defined by at least one slot which interacts with the corresponding weak-current contactor element.

3. The contactor carriage as claimed in claim 2, further comprising a first snap-fitting means for interacting with a second complementary snap-fitting means supported by said contactor element, in order to attach said contactor element removably to said carriage.

4. The contactor carriage as claimed in claim 3, wherein the first snap-fitting means comprises one of a protuberance or a hole.

5. The contactor carriage as claimed claim 1, further comprising two contactor elements, wherein the first housing designed for the strong-current contactor element is situated on the edge of said carriage relative to the second housing designed for the weak-current contactor element, situated in the center.

6. An electric switch of a motor vehicle in assembly of controls beneath a steering wheel of a motor vehicle, comprising:

a contactor carriage mounted to move in translation in the electric switch of the motor vehicle, in order to establish, according to a command of a user, an electric contact at one or more predefined positions on a path of said contactor carriage, the contactor carriage comprising:

at least one location of electric contact;

a first housing for receiving a strong-current contactor element; and a second housing for receiving a weak-current contactor element, so that an electric contact is established at said at least one location by one of installation of the strong-current contactor element in the first housing, or by installation of the weak-current contactor element in the second housing.

7. The switch as claimed in claim 6, wherein the strong-current contactor element comprises a contactor bridge and an elastic return spring of the contactor bridge.

8. The switch as claimed in claim 7, wherein the contactor bridge comprises two excrescences capable of establishing two simultaneous electric contacts.

9. The switch as claimed in claim 6, further comprising two strong-current contactor elements.

10. The electrical switch as claimed in claim 6, further comprising:

an elastic strip forming the weak-current contactor element, wherein said elastic strip is installed in the second housing of the contactor carriage, in order to establish, according to a command of a user, the electric contact for one or more predefined positions of the path of said carriage, wherein the elastic strip comprises:

at least one location of the electric contact, so that an electric contact is established at the at least one location, wherein the electric contact comprises a shape of a fork having at least two branches capable of establishing two simultaneous electric contacts, and wherein each branch comprises a curved end.

11. The electrical switch as claimed in claim 10, wherein each branch comprises at least two contactor arms.

12. The electrical switch as claimed in claim 10, further comprising a first snap-fitting means configured to interact with a second complementary snap-fitting means supported by said contactor carriage to attach said elastic strip removably to said contactor carriage.

13. The electrical switch according to claim 6, further comprising:

two elastic strips forming a weak-current contactor element, wherein said elastic strip is installed in the second housing of the contactor carriage, in order to establish, according to a command of a user, an electric contact for one or more predefined positions of the path of said carriage, the two elastic strips comprising:

at least one location of the electric contact, so that the electric contact is established at the at least one location, wherein the electric contact comprises a shape of a fork having at least two branches capable of establishing two simultaneous electric contacts, and wherein each branch comprises a curved end.

14. The electrical switch as claimed in claim 13, wherein each branch comprises at least two contactor arms.

15. The electrical switch as claimed in claim 13, further comprising a first snap-fitting means configured to interact with a second complementary snap-fitting means supported by said contactor carriage to attach said elastic strip removably to said contactor carriage.

* * * * *